US006989168B2

(12) United States Patent
Fahey

(10) Patent No.: US 6,989,168 B2
(45) Date of Patent: Jan. 24, 2006

(54) DUAL COMPARTMENT BEVERAGE CONTAINER

(76) Inventor: Lonnie J. Fahey, 524 Grove St. North, Belle Plaine, MN (US) 56011

( * ) Notice: Subject to any disclaimer, the term of this patent is extended or adjusted under 35 U.S.C. 154(b) by 0 days.

(21) Appl. No.: 10/414,628

(22) Filed: Apr. 16, 2003

(65) Prior Publication Data

US 2003/0201270 A1 Oct. 30, 2003

Related U.S. Application Data

(60) Provisional application No. 60/375,322, filed on Apr. 25, 2002.

(51) Int. Cl.
*B65D 1/04* (2006.01)

(52) U.S. Cl. ..... 426/120; 206/217; 215/6; 215/10; 220/504

(58) Field of Classification Search ..... 220/212, 220/500, 504, 523, 694, 710, 503, 505, 23.86, 220/916, 625, 506; 206/6, 10, 217, 804, 216; 229/103.1; 215/228, 388, 390, 6, 10, DIG. 8; 426/120

See application file for complete search history.

(56) References Cited

U.S. PATENT DOCUMENTS

| | | | | | |
|---|---|---|---|---|---|
| 1,709,168 | A | * | 4/1929 | Epperson | 426/86 |
| 1,993,978 | A | * | 3/1935 | Plochman | 215/6 |
| 2,013,475 | A | * | 9/1935 | Orton | 206/229 |
| 2,424,536 | A | * | 7/1947 | Mayer | 426/105 |
| 2,493,922 | A | * | 1/1950 | Miller | 215/6 |
| 2,766,796 | A | * | 10/1956 | Tupper | 220/521 |
| 3,377,773 | A | * | 4/1968 | Clark | 53/546 |
| 3,399,762 | A | * | 9/1968 | Potter | 206/499 |
| 3,590,989 | A | * | 7/1971 | Wittwer | 206/568 |
| 3,741,383 | A | * | 6/1973 | Wittwer | 206/219 |
| 4,392,576 | A | * | 7/1983 | Berger et al. | 215/12.2 |
| 4,651,890 | A | * | 3/1987 | Coker et al. | 220/694 |
| 4,948,641 | A | * | 8/1990 | Shantz et al. | 428/35.7 |
| 5,064,073 | A | * | 11/1991 | Folland | 220/521 |
| 5,415,282 | A | * | 5/1995 | Kienholz | 206/216 |
| 5,460,264 | A | * | 10/1995 | Rupert | 206/217 |
| 5,664,671 | A | * | 9/1997 | Nedblake, Jr. | 206/217 |
| 5,782,358 | A | * | 7/1998 | Walker | 206/509 |
| 5,881,868 | A | * | 3/1999 | Soyak et al. | 206/213.1 |
| 5,971,195 | A | * | 10/1999 | Reidinger et al. | 220/521 |
| 6,672,817 | B2 | * | 1/2004 | Denny | 426/110 |

FOREIGN PATENT DOCUMENTS

| | | | |
|---|---|---|---|
| CA | 1031738 | * | 5/1978 |
| DE | 2324844 | * | 12/1974 |
| GB | 2297306 | * | 7/1996 |

* cited by examiner

*Primary Examiner*—Joseph C. Merek
(74) *Attorney, Agent, or Firm*—Larkin Hoffman Daly & Lindgren Ltd.; Frederick W. Niebuhr, Esq.

(57) ABSTRACT

A container for vending single servings of beverages and snack foods, includes a liquid-impermeable wall providing a compartment for the beverage. An inside section of the wall defines a recess isolated from the compartment and open to the container exterior at the bottom. Near the upper end of the recess, the inside wall diameter is decreased in steps, to frictionally engage a leading edge region of a snack-food cartridge or other product inserted into the recess. A pull tab between the cartridge and the recess is accessible to remove the cartridge. Alternatively, a cartridge wrapper can be shaped to provide a pull tab component. The preferred snack-food cartridge includes a compliant thin film or foil wrapping surrounding a stack of cookies, a bar, or other snack food. In alternative arrangements, the container has a vertical slot for viewing a cartridge inserted into the recess, or is formed with horizontal top and bottom wall sections. Further alternatives involve a refrigeration package or chilled cartridge insertable into the recess to cool the beverage.

27 Claims, 6 Drawing Sheets

DUAL COMPARTMENT BEVERAGE CONTAINER

This application claims the benefit of priority based on Provisional Application No. 60/375,322 entitled "Liquid Container with Compartment for Accessory Product," filed Apr. 25, 2002.

BACKGROUND OF THE INVENTION

The present invention relates to containers that incorporate separate compartments for different products, and more particularly to containers for beverages and other liquids with incorporate interior compartments for containing food items, refrigeration packages, and other auxiliary products.

As even a casual visit to a supermarket or other food retailer will demonstrate, there is a wide variety of packaging designed to facilitate the storage and transport of different food items, and to present the food items in an attractive manner at the point of purchase. An increasingly favored segment of this packaging, often called product merging, involves containing and presenting combinations of different foods in a single package. Examples include crackers and cheese, different kinds of meat and/or cheese, and crackers with different spreads. Prepackaged complete meals include different compartments for different foods, e.g. a meat entrée and a vegetable entrée. Other examples of product merging include combining a food item with a prize, or with a utensil such as a spoon or straw.

Packaging for combinations of products is designed to meet a variety of needs, one of them being convenience to the consumer. Many purchasers appreciate the simplicity and ease resulting from a cost-effective merger or combination of complementary products. This is particularly the case where the merged products, when sold separately, are normally found at different locations at the food retailer. Convenience results from combinations of products often consumed together, but traditionally purchased separately. In a trend running counter to the tendency of many manufacturers to "super-size" their products, cost-conscious and health-conscious parents are inclined to purchase snacks for their children in packages that contain reduced quantities of the complementary products, thus offering a lower cost combination with less to carry and less to consume.

Another need for such packaging is efficiency in product distribution. Vending machine operators look for products that conform to, or are readily adaptable to, existing machines and distribution systems. The products involved are more acceptable when their packaging does not require any substantial changes to the product distribution system or to individual vending machines.

When one of the merged products is a liquid, containers for the product combination must meet certain requirements not present in many other product combination applications. These include the need for a container with sufficient structural integrity to "shape" the liquid, which typically assumes the shape of the container. The container wall must be impermeable to liquids, and in many cases also must be capable of forming a moisture seal, to effectively contain the liquid, and also to maintain the accessory product separate from the liquid.

Additional needs arise due to the nature of the accessory product. Snack foods such as cookies, crackers and chips may fracture or crumble easily, and consequently are better protected in packaging with sufficient structural integrity to maintain a desired shape. Because of this, past attempts to merge beverages and fragile snack items have resulted in packaging that is not particularly appealing or cost-effective. When rigid snack food packaging is combined with a bottle or other package containing a liquid, the end result is bulky, and often lacks consumer appeal.

The need for improvements in product merging containers has health implications as well. According to the U.S. Department of Agriculture, for example, milk consumption by children of ages 11 to 18 decreased by 36 percent from 1965 to 1996, while consumption of soft drinks and non-citrus juices climbed steadily. The decline in milk consumption during teenage and pre-teen years raises the risk, especially in women, of developing osteoporosis later in life. Increased milk consumption would be beneficial not only for the increased calcium consumption, but also because milk contains vitamin D to aid calcium absorption, and other essential nutrients important to early and later childhood growth and development.

The increase in soft drink and non-citrus juice consumption is a contributing factor to the increase in percentage of children deemed overweight, and increased rates of early-onset diabetes and heart disease. An attractively packaged combination of milk (or citrus juice) and an appropriate snack food would appeal to younger consumers, and perhaps counteract some of the disturbing trends in beverage consumption.

A variety of dual compartment containers have been developed to serve different needs. For example, a recently published U.S. patent application (Publication No. U.S. 2002/0040883) to Ciesla discloses a beverage bottle with an interior recess, open to the bottom of the bottle, for holding a stack of cups. The recess acts as a dispenser, allowing removal of one cup at a time. U.S. Pat. No. 5,211,299 (Manfredonia) is directed to a baby bottle with a recess open to the bottom for storing a truncated conical cap.

A baby bottle disclosed in U.S. Pat. No. 5,467,877 (Smith) includes a recess open to the bottom of the bottle for containing an ice pack core to keep the contents cool. The core is held in by a threaded cap removably attached to the bottom of the bottle. U.S. Pat. No. 6,293,435 (Forsberg) shows a liquid specimen container with a first fluid sample container having a lid at the top, and a second fluid sample container disposed within a recess open to the bottom of the first container. The recess is ribbed to frictionally hold the second container. A recess open to a container top is shown in U.S. Pat. No. 5,992,677 (Ebine). The recess is designed to hold a product, particle, prize or object such as a towelette.

Although the foregoing containers may be suitable for the purposes described in their respective patents, they fail to adequately address a variety of needs for vending and otherwise distributing containers of liquids and complementary products, particularly in the beverage and snack food industries.

Therefore, it is an object of the present invention to provide containers having a size and shape suitable for offering single servings of beverages through conventional vending machines, and further for containing complementary products in a manner that affords convenient access to the complementary products without interfering with consumption of the beverage.

Another object is to provide a container for a liquid and a complementary product that allows reclosure of the container after a partial consumption or other use of a beverage or other liquid, and preferably also allows convenient reinsertion of the complementary product after partial consumption or use, if desired.

A further object is to provide a system for conveniently containing two complementary products, including a container shaped to provide a compartment for one of the products and a recess separate from the compartment for containing the other product, in which the second product is closely surrounded by a compliant covering or wrap to provide a cartridge removably nested within the recess.

Yet another object is to provide a container with a liquid-impermeable wall forming a compartment for liquids and defining a recess isolated from the compartment, sized and shaped to contain an elongate cartridge removably axially insertable into the recess, and alternatively to contain an elongate core adapted to support the container in a dispensing position when inserted into the recess.

SUMMARY OF THE INVENTION

To achieve these and other objects, there is provided a container for a liquid and an accessory product. The container includes a liquid-impermeable wall shaped to provide a compartment for containing a liquid. The wall includes an outside wall section determining a periphery of the container. The wall further includes an inside wall section spaced apart inwardly from the outside wall section and defining a recess isolated from the compartment. The recess includes an access aperture open to an exterior of the container, and extends in an axial direction from the access aperture to an interior end within the container. The inside wall is shaped to provide a selected region near the interior end, extending in the axial direction and having a reduced dimension normal to the axial direction, whereby the inside wall along the selected region is adapted to frictionally engage a leading end region of an accessory product inserted through the access aperture into the recess, thereby tending to retain the accessory product in the recess.

In one preferred version of the container, the access aperture is disposed at the container bottom, and the inside wall section extends upwardly, concentric on a vertical axis. Below the selected region, the recess diameter is substantially constant. The outside wall section surrounds the inside wall section, preferably concentric on the same axis. Above the recess, the outside wall section is narrowed or inclined inwardly to provide a neck near the container top. A port at the container top allows liquids to enter and exit the compartment. A cap or other suitable closure member releasably closes the port.

This provides a container shape well suited for vending and convenient personal consumption of a beverage and snack food. The beverage can be completely or partially consumed without interfering with the snack food contained in the recess. Likewise, the snack food can be removed and consumed without interfering with consumption of the beverage. Because of the removable cap and frictional support of the snack food package, either the liquid or the snack food may be partially consumed, and the cap reattached or package reinserted.

Another advantage of this arrangement is that the outside wall, being relatively rigid, can protect a snack food or other complementary product, for example in ensuring that a package of chips or crackers cannot be squeezed to crumble or fracture the contents.

In one particularly preferred arrangement, the selected region of the recess is stepped to provide several axially extended step sections of progressively reduced diameter in the direction toward the interior end. The diameter of each step section can be constant. In alternative constructions, each step section is convex in the radially inward direction, or incorporates radially inwardly directed bumps or nodules. The step sections better ensure the desired frictional engagement of the snack food package or other complementary product within the recess, in spite of a variance in diameter from one complementary product package to another. The stepped recess also provides substantial surface area parallel or nearly parallel to the axis, which affords a much better frictional hold as compared to a tapered wall. A pull tab can be disposed between the package and the inside wall section, to facilitate removal.

Another aspect of the invention is a system for containing a plurality of constituents. The system includes a container having a container wall shaped to provide a compartment for containing a first constituent. The container wall includes an outside wall section determining an outer periphery of the container. The container wall further includes an inside wall section spaced apart from the outside wall section and defining a recess separate from the compartment with an access aperture open to an exterior of the container, and extended from the access aperture to an interior end within the container. A cartridge is removably nested within the recess. The cartridge includes a second constituent, and a cartridge wall formed of a compliant covering in surrounding relation to the second constituent, whereby the second constituent substantially shapes the cartridge.

The first constituent can be a beverage, in which case the second constituent preferably is a food selected for consumption with the beverage. In preferred embodiments a port is formed through the container wall to allow the liquid to enter and exit the compartment, with the wall liquid-impermeable to isolate the recess from the compartment. The port can be closed by a closure member releasably coupled to the container.

Another aspect of the present invention is an apparatus for containing, transporting and dispensing liquids. The apparatus includes a container having a liquid-impermeable container wall forming a compartment for liquids. The container wall includes an outside wall section centered on an axis, and substantially planar first and second end wall sections substantially orthogonal to the axis and disposed at opposite ends of the outside wall section. The container wall further includes an inside wall section spaced apart inwardly from the outside wall section. The inside wall section defines a recess isolated from the compartment, open to an exterior of the container, and extended inwardly to an interior end within the container. A port is formed through the outside wall section, and a closure member is adapted for a coupling with the container to close the port. The closure member also is releasable from the coupling to allow liquids to enter and exit the compartment through the port. The recess is sized and shaped to contain an elongate cartridge removably axially insertable into the recess, and alternatively to contain an elongate core. When axially inserted into the recess, the core is adapted to support the container in a dispensing position in which the port is disposed below the recess and the core.

Typically, the first and second end wall sections are substantially vertical when the container is in the dispensing position. The inside and outside wall sections preferably are concentric circular cylinders.

Different cartridges can be provided for different purposes. For example, a cartridge can comprise a food selected for consumption with the consumable liquid and a compliant thin film in close surrounding relation to the food item, whereby the food item substantially shapes the cartridge. As an alternative, the cartridge can be a solid body such as a refrigeration pack adapted to cool the liquid in the compartment, or maintain the liquid at a below-ambient temperature. As a further alternative, the solid body can be heatable to maintain the liquid at above-ambient temperatures.

Containers shaped according to this aspect of the invention are well suited for storing and shipping in off-center or staggered packing arrangements that allow a relatively large number of the containers to be housed within a refrigeration unit or other enclosure, with a high level of surface-area exposure to facilitate external cooling of the containers.

A further aspect of the present invention is a device for vending product combinations. The device includes a container with a liquid-impermeable container wall shaped to provide a compartment for containing a liquid. The container wall includes an outside wall section determining a container periphery. The container wall further includes an inside wall section spaced apart inwardly from the outside wall section and defining a recess isolated from the compartment, having an access aperture open to an exterior of the container, and extending from the access aperture to an interior end within the container. An accessory product is removably and frictionally contained within the recess. A pull tab component, associated with the accessory product, is accessible from outside the recess to facilitate use of the pull tab component to remove the accessory product from the recess by pulling the tab component.

The pull tab component can include a tab with an inside pull tab region disposed between a lead end of the accessory product and the interior end of the recess. Alternatively, a pull tab without such inside region may extend longitudinally along the accessory product, over most of the product length. In either case, the coupling of the pull tab and accessory product is sufficiently strong to ensure that when the tab is pulled, the accessory product moves with the tab. In cases where a frictional coupling of the tab and accessory product may not suffice, the pull tab can be bonded to the accessory product with an adhesive. Frequently the accessory product takes the form of a cartridge that includes a food item and a polymeric thin film or foil wrapper covering the food item, in which case an end portion of the wrapper can provide the pull tab component.

Thus in accordance with the present invention, liquids and complementary products, especially beverages and food items, are contained in a manner suitable for convenient vending and personal consumption, in a manner that protects the food item or other complementary product, and facilitates consumption of the products together. The container also permits selective individual consumption of either the liquid product or the food product alone if desired, without interfering with containment of the other product. Finally, the containers can be shaped for a multiple container storage arrangement that affords maximum surface area exposure, e.g. for more rapid cooling in a refrigeration unit.

IN THE DRAWINGS

For a further appreciation of the above and other features and advantages, reference is made to the following detailed description and to the drawings, in which.

Figure 3A:
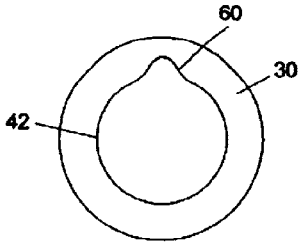
Figure 4:
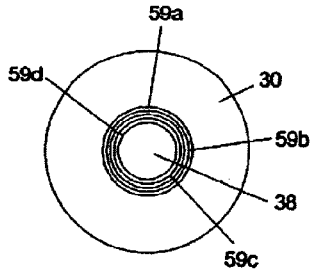
Figure 3B:
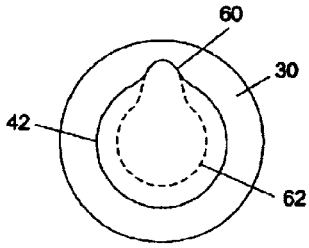
Figure 5:
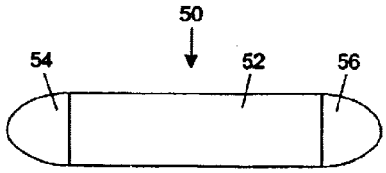
Figure 6:
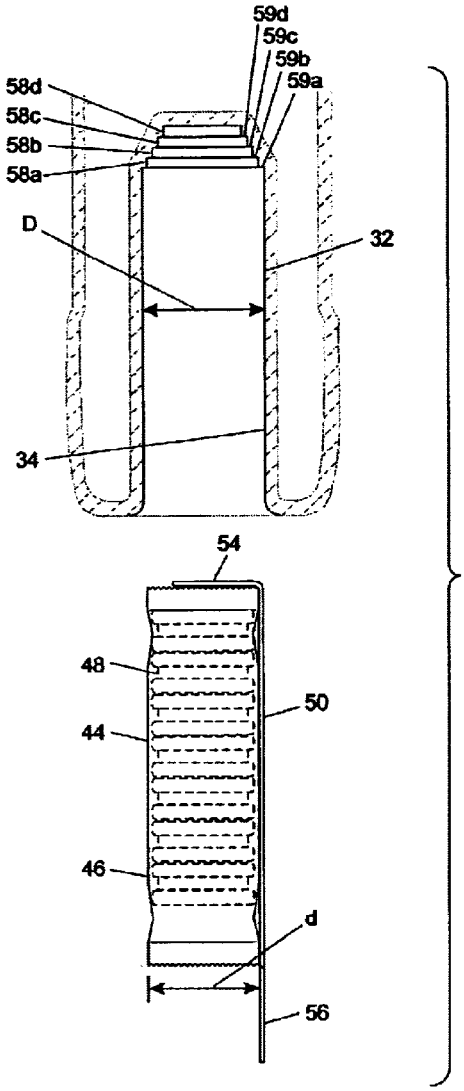
Figure 7:
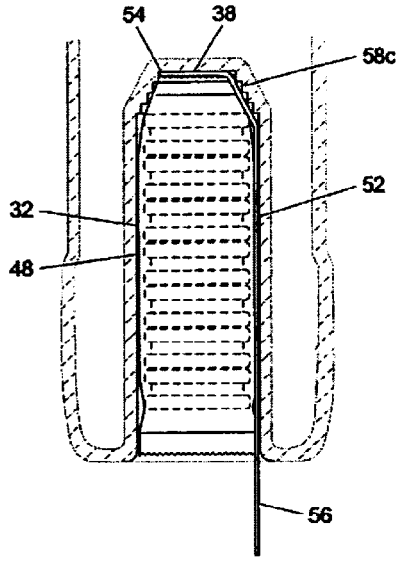
Figure 8:
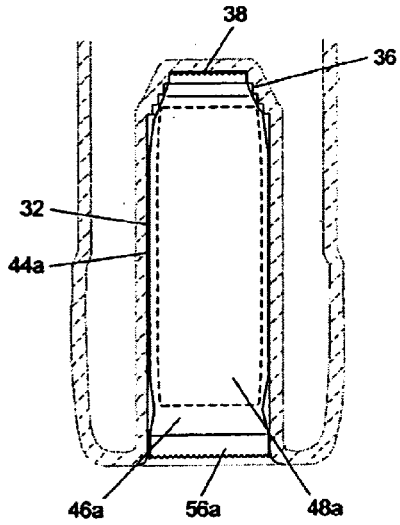
Figure 13:
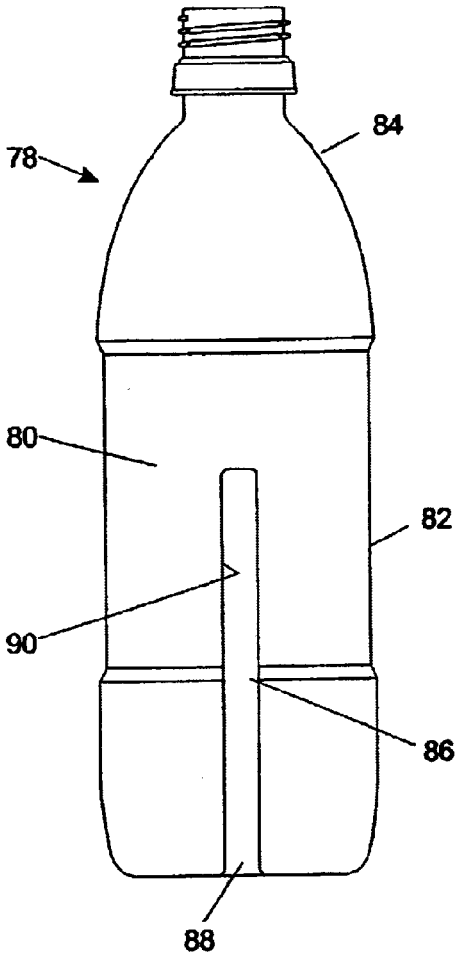
Figure 14:
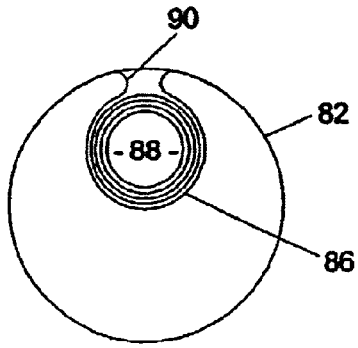
Figure 15:
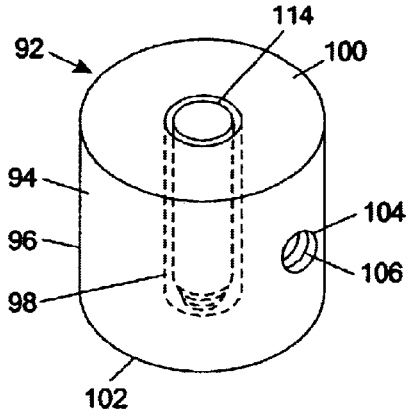
Figure 16:
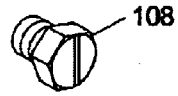
Figure 17:
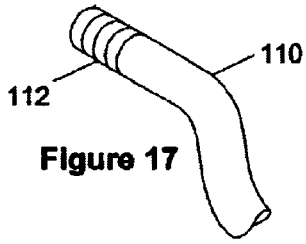
Figure 18:
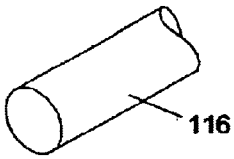
Figure 19:
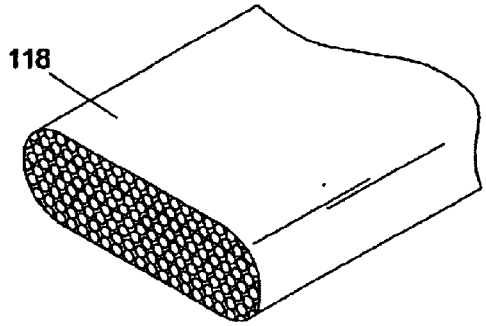
Figure 20:
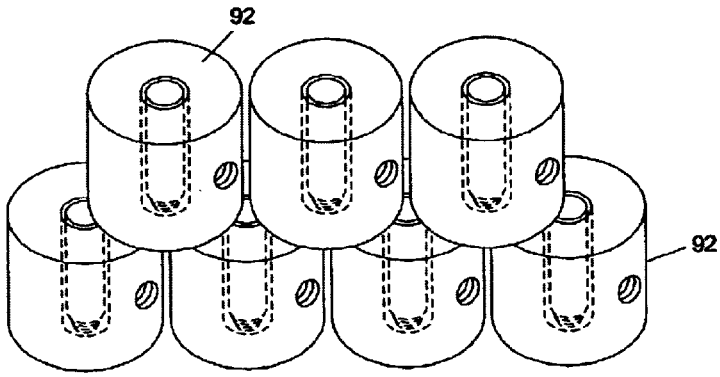
Figure 21:
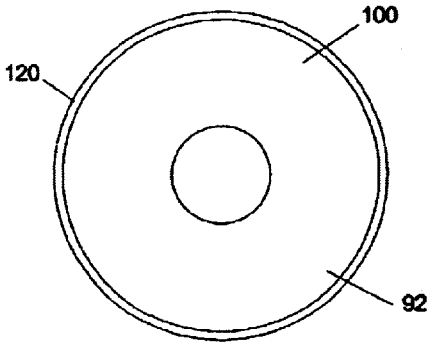
Figure 22:
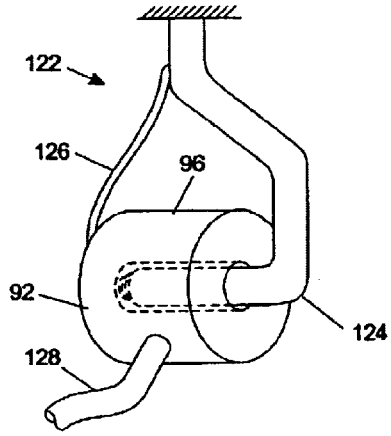
Figure 23:
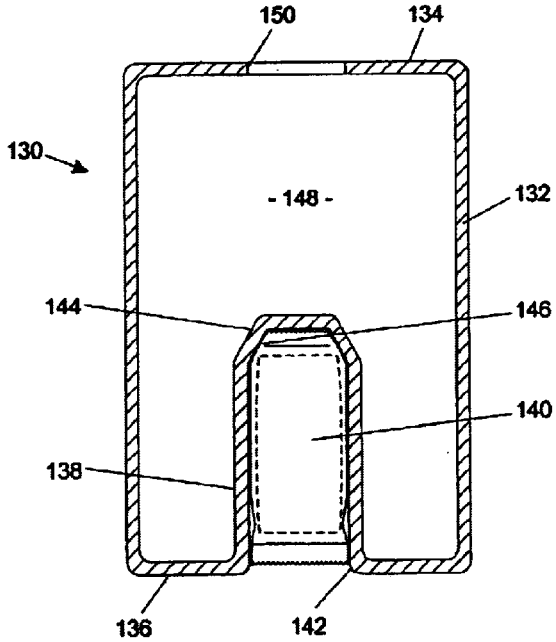

FIGS. 3*a* and 3*b* are bottom views of the container showing alternative embodiment tamper-indicating seals;

FIG. 4 is a bottom view of the container, with the tamper-indicating seal and cartridge removed, showing a stepped recess in the container for housing the cartridge;

FIG. 5 is a plan view of a pull tab suitable for removing a cartridge from the recess;

FIG. 6 is a schematic view of the recess in profile, with the cartridge and pull tab positioned for insertion;

FIG. 7 is a view similar to FIG. 6, but with the cartridge and pull tab inserted into the recess;

FIG. 8 is a view similar to FIG. 7, illustrating an alternative cartridge and pull tab inserted into the recess;

FIGS. 9–12 are bottom views of alternative embodiment containers illustrating different container profiles and recess profiles;

FIG. 13 is an elevational view of another alternative embodiment container;

FIG. 14 is a bottom view of the container in FIG. 13;

FIG. 15 is a prospective view of a further alternative embodiment container;

FIG. 16 is a perspective view of a threaded cap used with the container in FIG. 15;

FIG. 17 is a partial perspective view of a conduit for dispensing a liquid from the container of FIG. 15;

FIG. 18 is a partial prospective view of a cartridge insertable into a recess of the container;

FIG. 19 is a partial perspective view of a refrigeration package insertable into the recess;

FIG. 20 is a perspective view of a stacking arrangement of containers similar to the container in FIG. 15;

FIG. 21 is a top plan view of the container;

FIG. 22 is a perspective view of the container of FIG. 15 and a device for supporting the container in a dispensing orientation; and FIG. 23 is a sectioned elevational view of an alternative embodiment container in the form of a pull-top can.

DETAILED DESCRIPTION OF THE PREFERRED EMBODIMENTS

Figure 1:
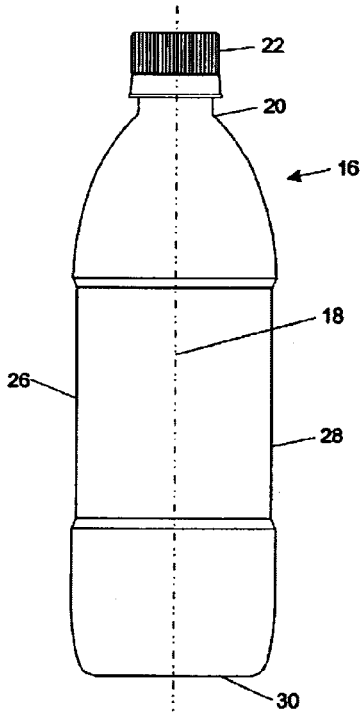
FIG. 1 is an elevational view of the container for a beverage and snack food combination, constructed in accordance with the present invention.
Figure 2:
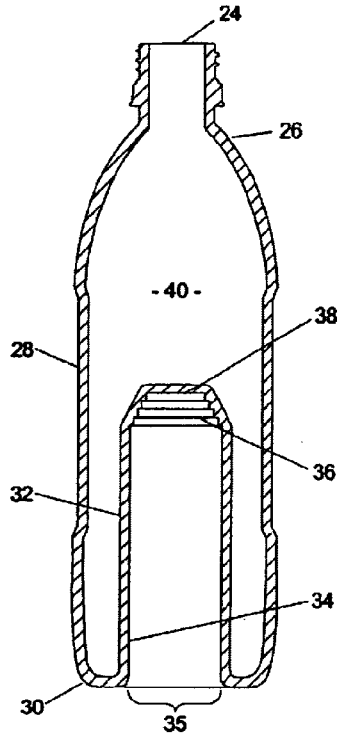
FIG. 2 is a sectional view of the container in FIG. 1, taken along a vertical plane through the container.

Turning now to the drawings, there is shown in FIGS. 1 and 2 a dual compartment beverage container 16 in the form of a bottle symmetrical about a vertical axis 18. Over most of its length, container 16 has a vertical outside profile, defining a circular cylinder. Above the cylinder, the profile includes a neck 20. A cap 22 is threaded into the container or otherwise releasably attached to the container at the top, to selectively open and close an opening 24 at the top of the container to accommodate the entry and exit of liquids.

As best seen in FIG. 2, container 16 apart from cap 22 is unitary, formed of a single, continuous container wall 26. Wall 26 includes an outside wall section 28 that determines the profile of the container, in this case generally a circular cylinder over a majority of the container length including the bottom, combined with an inward, then outward taper near the top to provide neck 20. The container wall further includes an annular bottom section 30 and an inside wall section 32 in the form of an upright circular cylinder centered on axis 18. Inside wall section 32 defines a recess 34 with an access aperture 35 open to the exterior of container 16 at the container bottom. Near the top of the recess, inside wall section 32 is layered or stepped to provide a reduced-diameter interior region 36 suitable for frictionally holding a packaged food item or other complementary product within the recess. Container wall 26 includes an end section 38 defining the upper, interior end of the recess.

Thus, container wall 26 is shaped to define two product containment regions: recess 34; and a compartment 40 for containing a beverage or other liquid encompassing the annular area between inside and outside wall sections 32 and 28 and the region above the recess.

Container wall 26 preferably is formed of polyethylene. Other suitable polymers include polypropylene, PVC (polyvinyl chloride), and PET (polyethylene terepthalate). The single, continuous container wall structure can be formed by a blow mold process, e.g. injection blow molding, extrusion blow molding, or a stretch blow molding that may or may not entail reheating a molded preform before it is expanded within a mold. In other constructions, the container wall sections can be formed separately and later fused or otherwise bonded together. In any event, the container wall must be liquid impermeable, and must exhibit sufficient structural integrity to maintain the desired profile under expected handling of the containers in storage and shipping. To this end, the container wall when formed of a polymer can be substantially rigid when the wall is relatively thick, or alternatively elastically deformable when the container wall is relatively thin. Other container constructions may employ materials other than polymers, e.g. glass or metal. The container wall can be transparent to draw attention to the accessory product, translucent to indicate the presence of an accessory product, or opaque to conceal the accessory product from view.

As seen in FIGS. 3*a* and 3*b*, container 16 preferably includes a seal or closure 42 applied to the container bottom after the accessory product is inserted into the recess. Seal 42 preferably is configured to be destroyed or irreversibly changed by any attempt to remove it from container 16, thus to provide an indication of tampering. Removal of seal 42 allows removal of the accessory product from recess 34. FIG. 4 shows the bottom of container 16, with the seal removed, to allow insertion or withdrawal of the accessory product.

As seen in FIG. 6, the accessory product is advantageously provided in the form of a cylindrical cartridge 44. The cartridge includes a cartridge wall or covering 46 formed of a polymeric thin film or a thin sheet material such as cellophane. Thin film 46 is wrapped in close surrounding relation about the accessory product, for example a stack of cookies 48. Wall 46 can be self-supporting if desired. However, in most cases the wall is compliant, conforming to the shape of the product it contains. This reduces the cost of the cartridge, and in many cases lends a degree of flexibility to the cartridge that is beneficial in retaining the cartridge within recess 34.

If desired, cartridge 44 can be augmented with a pull tab 50 (FIG. 5) to facilitate removal of the cartridge from the recess. The pull tab includes an elongate main body 52, a top portion 54, and a bottom portion 56. The main body is positionable along the cartridge length, with top portion 54 overlying the upper or inside surface of the cartridge, as shown in FIG. 7. If desired, pull tab 50 is secured to cartridge 44 with an adhesive at top portion 54, and optionally along main body 52 as well. Bottom portion 56 of the tab is not attached to the cartridge, but overlies the bottom surface of the cartridge when seal 42 is in place. Upon removal of the seal, tab bottom portion 56 extends away from the recess for convenient access.

Cartridge 44 has a substantially uniform diameter d over its entire length. Similarly, recess 34 has a substantially uniform diameter D along most of its length, excepting stepped interior region 36. Cartridge diameter d preferably is slightly less than recess diameter D, to ensure convenient insertion and removal of the cartridge. Interior region 36 is formed as a series of axially extending step sections 58*a–d* and radially extending shoulders 59*a–d*, one associated with each step section. Along the interior region, the recess diameter is decreased progressively in step sections 58*a–d*, to the point where the diameter of the most inward step section 58*d* is less than the cartridge diameter d. As a result, cartridge 44 typically is not insertable into recess 34 to the point of engaging end section 38, but rather is disposed spaced apart from the end section as seen in FIG. 7. Preferably, several of step sections 58 of interior region 36 have diameters close to the cartridge diameter d, including step sections with diameters slightly above and slightly below diameter d. Further, although the food item may be brittle and subject to crumbling in response to an applied force, the combination of the food item and thin film wrapping imparts a degree of flexibility to the cartridge as a whole. In addition, the inside wall section, particularly along region 36, may be slightly elastically deformable, depending on the material selected for container 16. The result is a frictional engagement of the cartridge and container along several of the stepped sections, as shown in FIG. 7. Wall section 32 below interior region 36 may or may not contribute to the frictional hold, depending on the size and flexibility of cartridge 44.

In short, the recess along interior region 36 is sized and shaped with respect to the cartridge to promote a wedging action as the cartridge is inserted, which tends to maintain the cartridge within the recess. The stepped construction of interior region 36 enhances the frictional hold afforded by the wedging action. This is due to the axial orientation of step sections 58*a–d*, a vertical orientation as seen in FIG. 6. When cartridge 44 is fully inserted as viewed in FIG. 7, the step sections in contact with cartridge 44 apply a radially inward compressive force, horizontal as viewed in the figure. The horizontal shoulders between successive step sections exert no substantial force against the cartridge. Accordingly, the holding force exerted by the wall section has virtually no vertical component. Further, providing step sections 58*a–d* with a longer axial dimension, as compared to the radial dimension of shoulders 59*a –d*, tends to increase the area of surface contact between interior region 36 and cartridge 44.

An alternative construction features bulged or rounded step sections. Each step section extends axially as before, but further is convex, in that the diameter of recess 34 along the step section varies between a minimum value at or near the center of the step section, and a maximum value at opposite ends of the step section. Preferably, the axial dimension of each step is less than the radius of curvature, such that the degree of convexity is slight. In a further alternative construction, each step section incorporates radially inwardly directed nodules or bumps.

Thus, the diameter of each step section can vary. Regardless of whether the diameter of each step section is constant, or considered as an average diameter in the case of a convex or otherwise slightly curved step section, the step section diameters decrease progressively in the axially inward direction.

If step sections 58*a–d* were replaced with a smooth, inclined wall section along interior region 36, the force on the cartridge due to the inside wall would have a vertical (downward) component as viewed in the figure. The vertical component would tend to push cartridge 44 downwardly out of the recess, and the frictional hold provided by the horizontal component would need to be stronger, to overcome this tendency. Providing sufficient horizontal force might be difficult, because the tendency of the vertical force component to increase in proportion to any increase in the horizontal component. By minimizing the vertical force component, the stepped construction overcomes this problem.

Another factor tending to maintain the cartridge in the recess is pull tab 50. As seen in FIG. 7, top portion 54 of the pull tab is disposed between the cartridge and end section 38, extending at about a 90 degree angle relative to main body 52 of the pull tab. Part of main body 52, particularly near top portion 54, is maintained under elastic compression between the cartridge and interior region 36, and thus contributes to the frictional hold maintaining the cartridge within the recess.

When seal 42 is opened or removed from container 16, bottom portion 56 of the pull tab extends outwardly, to facilitate a gripping of the pull tab and pulling it downwardly to remove cartridge 44 from the recess. Because of pull tab 50, recess 34 can have a diameter D that just slightly exceeds the cartridge diameter d, for a more efficient use of container volume. Without pull tab 50, close sizing of the cartridge and recess might render cartridge 44 difficult to remove by hand, and the difficulty would increase with the strength of the frictional hold. The pull tab readily overcomes this difficulty, even when its upper portion contributes to the frictional hold.

When still affixed to the container, seal 42 folds the pull tab so that bottom portion 56 overlies the bottom of the cartridge. In this position, seal 42 closes access aperture 35 to help maintain the cartridge within the recess.

Seal 42, as best seen in FIG. 3*a*, includes a tab portion 60 that can be grasped by hand to pull the seal away from the container bottom. In this embodiment the seal is secured to bottom section 30 with an adhesive that does not permit reattachment, so that once opened or pulled away from the container bottom, the seal cannot conveniently be reattached. Thus, seal or closure 42 remains open, indicating that the seal provided by the adhesive has been broken. More preferably, the adhesive bonds seal or closure 42 to the container bottom with sufficient strength such that pulling the seal away from the container bottom tears the seal rather than breaking the bond. On a container in which the seal has been opened, a torn seal gives a warning of possible tampering with cartridge 44. In an alternative embodiment (FIG. 3*b*), perforations can be formed along the seal as indicated at 62, so that pulling tab portion 60 tends to tear the seal or closure along the line formed by the perforations. Seal 42 preferably is formed of polyethylene or another suitable polymer.

As indicated above, the containers of the present invention are directed to concerns of health and convenience. More particularly, container 16 is particularly well suited for the convenient vending and consumption of milk and food items frequently consumed with milk, e.g. cookies. This combination appeals to younger consumers, counteracting the aforementioned trend among these consumers to reduce their milk consumption. Similarly, container 16 can be used to market combinations of orange and other citrus juices with crackers or other snacks, to encourage consumption of these juices. Container 16 is well suited for convenient vending and consumption of a wide variety of carbonated beverages or adult beverages with food, e.g., soft drinks with snack bars or candy bars, or beer with pretzels or peanuts.

To facilitate distribution of the beverage and cartridge, container 16 preferably is provided in a size and shape suitable for present-day standard vending machines. In one example, container 16 is provided in the size and shape currently used to vend milk and other beverages in 20-ounce quantities. With cartridge 44 occupying part of the volume, the beverage capacity of compartment 40 is about 16 ounces. One preferred version contains milk in combination with Oreo (brand name) mini-cookies. In other versions of the container, soft drinks are combined with certain snacks, e.g. chips or bite sized candy bars.

The container size and shape are factors that contribute to the convenience of consuming the beverage/food combination. Another factor relates to how consumers gain access to the beverage and food, respectively. With opening 24 at the top of the container, and recess 34 open at the bottom, container 16 (FIG. 2) provides access to each of the beverage and food item, independently of the other. Each of the products may be consumed completely or partially, as desired. With respect to milk or another beverage, cap 22 is threadedly or otherwise removably secured to facilitate reclosure after partial consumption. As for the cookies or other food item, cartridge 44 preferably is configured to be opened at the top, i.e. the inside end when the cartridge is inserted into recess 34. Removal of several cookies 48 leaves the upper portion of cartridge wall 46 without support, so that it tends to collapse downwardly toward the remaining cookies when the cartridge is reinserted into the recess. The tendency of cartridge wall 46 to collapse or fold over upon itself may cause the cartridge wall to form into several layers near the inner end of the cartridge, slightly enlarging the cartridge diameter near the inward end. Nonetheless, recess 34 is adapted to maintain a frictional hold on the partially filled cartridge, due to the stepped arrangement along interior region 36. Pull tab 50 also assists in maintaining the frictional hold, and remains accessible for pulling the cartridge out of the recess when the user desires further access to the cookies or other contents.

FIG. 8 illustrates an alternative cartridge 44*a* inserted into and frictionally held within recess 34, specifically along narrowed interior region 36 as before. The cartridge includes a covering in the form of a metal foil wrapper 46*a*, and a bite sized candy bar 48*a* contained within the foil wrapper. Foil wrapper 46*a* is compliant, whereby bar 48*a* substantially shapes the cartridge. Bar 48*a* may have a non-circular or irregular shape, and thus cartridge 44*a* may not have a uniform diameter. However, the cartridge does have a major dimension in the radial direction equivalent to a diameter. This, in combination with the tendency of foil 46*a* to fold over upon itself or bunch along interior region 36, provides the desired frictional hold.

The arrangement includes a pull tab component in the form of a flat end portion 56*a* of the foil wrapper that provides for access from outside the recess. Although tab component 56*a* does not have portions equivalent to body 52 and top portion 54 of tab 50, the bar and foil wrapper cooperate to provide an effective frictional hold, even though they may not conform to the shape of inside wall 32. The frictional hold is readily overcome by pulling the tab component axially away from the container. While a flat end portion is preferred, foil wrapper 46*a* can be twisted or otherwise shaped to provide the tab component.

Figure 9:
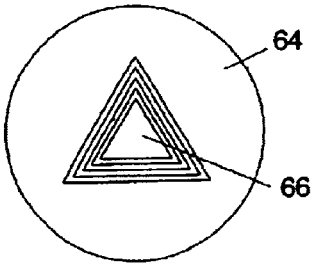
Figure 10:
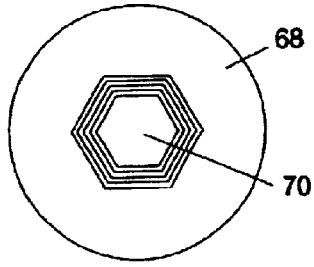

FIGS. 9–12 are bottom views of alternative embodiment containers. In each case, the seal and the cartridge containing a food item or other accessory product are removed, to illustrate the shape of the recess. In FIG. 9, a container 64 includes a recess 66 with a triangular profile. FIG. 10 illustrates an alternative container 68 in which a recess 70 has a hexagonal profile. The cartridges associated with containers 64 and 68 include thin-film walls, wrapped about stacks of crackers, chips or other items having the desired profile and stacked vertically to give the associated cartridges their desired shapes.

Figure 11:
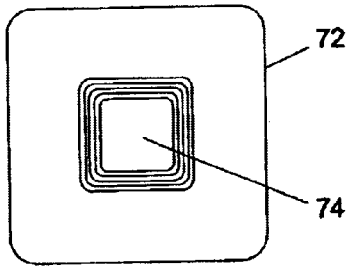
Figure 12:
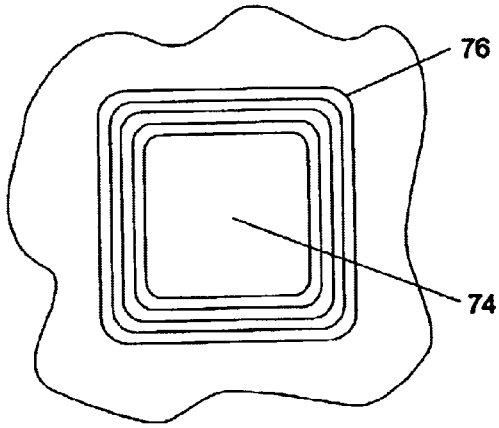

FIGS. 11 and 12 illustrate another alternative container 72 with a wall shaped to provide a square or rectangular outside profile and recess 74. As seen in the enlarged partial view in FIG. 11, the inside wall section of container 72 preferably is formed with a radius 76 at each corner. The slightly rounded shape of the recess is more compatible with the various molding processes used to form the containers, and usually is better suited for accommodating the cartridge. Recesses 66, 70 and 74 are provided with stepped interior regions similar to interior region 36 of recess 34.

FIGS. 13 and 14 illustrate an alternative embodiment container 78 preferably formed of a single, continuous container wall 80 including an outside wall section 82 generally in the shape of a circular cylinder, and incorporating inward and outward tapers near the top to provide a neck 84, similar to the shape of container 16. Container wall 82 further includes an inside wall section 86 substantially surrounded by the outside wall section and defining a recess 88 open to the bottom of the container. In a departure from container 16, outside wall section 82 does not entirely surround the inside wall section, thus forming an elongate vertical slot 90. Nonetheless, as seen in FIG. 14, inside wall section 86 is shaped to substantially surround a cartridge inserted into recess 88. While a cartridge is not shown in these figures, it is apparent from FIG. 13 that a lengthwise section of any cartridge contained in recess 88 will be visible from outside the container through slot 90. Consequently a promotional message, ornamentation or descriptive material applied to that section of the cartridge is visible through the slot.

In a second departure from container 16, recess 88 is not centered within outside wall section 82, but is offset toward one side of the container, as best seen in FIG. 14. As is the case with the other embodiments, container 78 and recess 88 can be formed in a variety of alternative shapes. Containers formed according to the present invention can provide a wide variety of combinations of beverages such as milk, water, soft drinks and adult beverages, combined with cookies, crackers, chips, peanuts, sunflower seeds, pretzels, cashews and other snack food. In alternative versions, the cartridges can contained powdered or crystalline materials intended to be mixed with the liquid. Specific combinations include milk with chocolate or other flavoring powder, water with powdered milk or powdered drink mixes such as those sold under the brand names "Tang" and "Kool-Aid." In further alternative containers, a toy, collectible or certificate representing a prize can be enclosed within the container recess, with or without a cartridge.

FIG. 15 is a perspective view of a cylindrical container 92 with a container wall 94 including a cylindrical outside section 96, a cylindrical inside section 98 coaxial with the outside section, a planar, annular top section 100, and a planar bottom section 102. An opening 104, provided with internal threads as shown at 106, extends through outside section 96 to provide access to the inside of the container. The opening is closed using an externally threaded cap 108 (FIG. 16). Alternatively, a line 110 with an externally threaded end 112 (FIG. 17) can be removably coupled within opening 104 for filling the container, or alternatively for removing a liquid.

Inside wall section 98 forms a cylindrical recess 114 open at the top of container 92, rather than at the container bottom as in the previous embodiments. Accordingly, an accessory product or cartridge is maintained in the container by gravity. A closure such as seal 42 is not required, although such closure can be used to maintain a product within the recess.

In lieu of an accessory product, recess 114 may be loaded with a cartridge 116 (FIG. 18) in order to chill a liquid in container 92, heat the liquid, or to assist in maintaining the liquid at a temperature either above or below ambient. In one specific application, container 92 is used to contain blood or blood plasma. Cartridge 116 is chilled prior to its insertion into recess 114. Cartridge 116 then refrigerates the blood or blood plasma, by removing heat from the surrounding liquid through inside wall section 98.

FIG. 19 illustrates a refrigeration package 118 that can be used as an alternative to cartridge 116. The refrigeration package does not require chilling prior to its insertion into recess 114. Typically, refrigeration package 118 contains two chemicals, separated from one another by a membrane or other divider that is ruptured when the package is bent or squeezed. Once they begin to mix with each other, the chemicals undergo an endothermic reaction that removes heat from the surrounding liquid to provide the desired refrigeration.

The internal refrigeration provided by cartridge 116 or package 118 can be augmented with external refrigeration if desired, by storing one or more of the containers in a refrigerator or cooler. FIG. 20 illustrates an off-center or staggered packing arrangement advantageous when several containers 92 are housed within a cooler or refrigerator. The staggered arrangement, particularly for circular cylindrical containers like container 92, maximizes surface-area exposure of the containers, thus facilitating the external cooling of the blood or blood plasma.

FIG. 21 illustrates a further alternative for improved refrigeration in the form of an insulative sleeve 120 surrounding container 92. The insulative sleeve increases the length of time over which cartridge 116 or package 118 can maintain the liquid temperature at desired levels below ambient.

FIG. 22 illustrates a device 122 usable to support container 92 in a substantially horizontal orientation for dispensing blood intravenously. Device 122 includes a core 124 insertable into recess 114 after the cartridge or package has been removed. In addition, the device preferably includes a flexible component 126, positionable against the container to provide a slight elastic restoring force against bottom section 102, whereby component 126 tends to maintain core 124 inside recess 114. Blood is provided through a line 128 removably coupled within opening 104 by complementary threads or other suitable means.

While container 92 is particularly useful for storing, refrigerating and transporting blood or blood plasma, it can be appreciated that a wide variety of liquids may be stored, transported and later dispensed using container 92.

A further alternative embodiment container 130 (FIG. 23) is shown in section to illustrate a continuous container wall including an outside wall section 132, a substantially planar top wall section 134, a substantially planar bottom wall section 136 and an inside wall section 138 that forms a recess open to the bottom of the container. A cartridge 140, consisting of a food item and compliant covering as in certain previous embodiments, is contained within a recess 142. The recess includes an interior region 144 with an annular inwardly projected rim 146 for frictionally maintaining the cartridge in the recess. Alternatively, the interior region can have inward projections such as nodules or bumps, or can be stepped as previously described. The container wall forms a compartment 148 for liquids with a top opening 150, with a closure, not shown. In one preferred version, container 130 is an aluminum can, in which case the closure preferably is a pull top. Alternatively, container 130 can be formed by injection molding from one of the previously mentioned polymers.

Combinations suited for distribution in container 130 include soft drinks with chips, crackers or bite sized candy bars, and beer with peanuts or other snack foods. To facilitate vending, container 130 can be formed in the size and shape of a standard twelve ounce beverage can, to provide approximately nine ounces of the beverage in combination with the food item. A seal or closure (not shown) similar to seal 42 can be mounted to bottom section 136, to assist in maintaining the cartridge in the recess and to provide an indication of tampering.

Thus, in accordance with the present invention, a container is provided with a size and shape suitable for combined vending of single servings of a beverage and accessory product in a manner that affords convenient access to the accessory product without interfering with consumption of the beverage. The beverage and accessory product may be only partially consumed if desired, with the container being reclosable to contain beverage not yet consumed, and with a cartridge configured to allow its reinsertion into a container recess after partial consumption of the accessory product. To ensure a more reliable frictional retention of the accessory product, particularly when provided as a cartridge insertable into a container recess, the recess includes an interior region along which the wall forming the recess is stepped or otherwise shaped to progressively decrease the recess diameter. As a result, the recess can accommodate cartridges that vary over a wider range of diameters, and is better suited to retain a cartridge reinserted into the recess after partial consumption of its contents.

What is claimed is:

1. A system for containing a plurality of constituents, including:

a container having a container wall shaped to provide a compartment for containing a first constituent, said container wall including an outside wall section determining an outer periphery of the container;

said container wall further including an inside wall section spaced apart inwardly from the outside wall section and defining a recess separate from the compartment, having an access aperture open to an exterior of the container, and extending from the access aperture to an interior end within the container; and a cartridge removably nested within the recess, said cartridge including a second constituent and a compliant covering in surrounding relation to the second constituent whereby the second constituent substantially shapes the cartridge; and the inside wall section, along a selected region proximate the interior end, is adapted to frictionally engage a leading end region of the cartridge when inserted through the access aperture into the recess, thereby tending to retain the cartridge in the recess; and a pull tab disposed between the cartridge and the inside wall section, and accessible from outside of the recess to facilitate a removal of the cartridge from the recess by pulling the tab.

2. The system of claim 1 wherein:

the covering consists essentially of a polymeric thin film.

3. The system of claim 1 wherein:

the covering consists essentially of a metal foil.

4. The system of claim 1 further including:

a port formed through the container wall, and a closure member adapted for a coupling with the container to close the port, and releasable from said coupling to allow liquids to enter and exit the compartment through the port, wherein the wall is liquid-impermeable and isolates the recess from the compartment.

5. The system of claim 4 wherein:

the first constituent comprises a consumable liquid, and the second constituent comprises a food selected for consumption with the liquid.

6. The system of claim 1 wherein:

said selected region comprises a reduced-diameter region of the recess.

7. The system of claim 6 wherein:

the selected region comprises a plurality of steps providing step sections of progressively reduced diameter in the direction toward said interior end.

8. The system of claim 1 further including:

a seal removably attached to the container wall to close the recess.

9. The system of claim 8 wherein:

the seal is configured to provide an indication of tampering.

10. The system of claim 1 wherein:

the inside wall section is cylindrical and centered on an axis, and the outside wall section surrounds the inside wall section and is coaxial with the inside wall section.

11. The system of claim 1 wherein:

the container has a size and shape selected to facilitate an accommodation thereof in a vending machine.

12. The system of claim 1 wherein: the pull tab is secured to the compliant covering.

13. A device for vending product combinations, including:

a container including a liquid-impermeable wall shaped to provide a compartment for containing a liquid, said container wall including an outside wall section determining a container periphery;

said container wall further including an inside wall section spaced apart inwardly from the outside wall section and defining a recess isolated from the compartment, having an access aperture open to an exterior of the container, and extending from the access aperture to an interior end within the container;

an accessory product removably contained within the recess; and a pull tab component associated with the accessory product and accessible from outside the recess to facilitate use of the pull tab component to remove the accessory product from the recess by pulling the tab component;

wherein said inside wall section, along a selected region of the recess near the interior end, is adapted to frictionally engage a leading end region of the accessory product when inserted into the recess, thereby tending to frictionally retain the accessory product in the recess; and, a port formed through the top section, and a closure member adapted for a coupling to the container to close the port and releasable from the coupling to allow liquids to enter and exit the compartment through the port, wherein the recess is open to said exterior at the bottom of the container.

14. The device of claim 13 further including:

a compliant covering in surrounding relation to the accessory product and cooperating with the accessory product to provide a cartridge whose shape is determined substantially by the accessory product, wherein a portion of the compliant covering forms the pull tab component.

15. The container of claim 14 wherein:

the cartridge comprises a food selected for consumption with a consumable liquid contained in the compartment, and a compliant thin film in close surrounding relation to the food.

16. The device of claim 13 wherein:

said pull tab component includes a pull tab having an inside tab portion disposed between a lead end of the accessory product and the interior end of the recess.

17. The container of claim 13 wherein:

the recess is narrower along the selected region.

18. The device of claim 17 wherein:

the selected region comprises a plurality of steps providing step sections of progressively reduced diameter in the direction toward the interior end.

19. The container of claim 13 further including:

a seal removably attached to the first end section to close the recess.

20. The container of claim 19 wherein:

the seal is configured to provide an indication of tampering.

21. The device of claim 13 wherein:

the container has a shape and size selected to facilitate accommodation thereof by a vending machine.

22. The device of claim 18 wherein:

the selected region further includes a plurality of radially extending shoulders alternating with the step sections, wherein the step sections extend in said direction toward the interior end.

23. The device of claim 22 wherein:

a dimension of each step section in the direction toward the interior end is longer than a radial dimension of each shoulder.

24. The device of claim 13 wherein:

the pull tab component includes a pull tab having a body portion extended in said direction toward the interior end and disposed between the accessory product and the inside wall section.

25. The device of claim 24 wherein:

the body portion is elastically compressed when so disposed and thereby assists in frictionally retaining the accessory product within the recess.

26. The system of claim 1 wherein:

the outside wall section substantially surrounds the inside wall section to position at least part of the compartment outside of the inside wall section, and between the inside wall section and the outside wall section.

27. The device of claim 13 wherein:

the outside wall section substantially surrounds the inside wall section to position at least part of the compartment outside of the inside wall section, and between the inside wall section and the outside wall section.

* * * * *